US009797167B2

(12) United States Patent
Schuling et al.

(10) Patent No.: US 9,797,167 B2
(45) Date of Patent: Oct. 24, 2017

(54) LOCKING MECHANISMS AND TOOLBOXES INCLUDING LOCKING MECHANISMS

(71) Applicant: Dee Zee, Inc., Des Moines, IA (US)

(72) Inventors: Eric Schuling, Bondurant, IA (US); Kyle Fichtner, Johnston, IA (US); Brian Vitiritto, Des Moines, IA (US)

(73) Assignee: Dee Zee, Inc., Des Moines, IA (US)

( * ) Notice: Subject to any disclaimer, the term of this patent is extended or adjusted under 35 U.S.C. 154(b) by 0 days.

(21) Appl. No.: 14/533,269

(22) Filed: Nov. 5, 2014

(65) Prior Publication Data

US 2015/0121974 A1 May 7, 2015

Related U.S. Application Data

(60) Provisional application No. 61/900,038, filed on Nov. 5, 2013.

(51) Int. Cl.
*B65D 55/14* (2006.01)
*E05B 65/52* (2006.01)
(Continued)

(52) U.S. Cl.
CPC ..... *E05B 65/52* (2013.01); *B25H 3/02* (2013.01); *E05B 15/025* (2013.01);
(Continued)

(58) Field of Classification Search
CPC ..... Y10T 292/096; Y10T 292/1016; Y10T 292/1014; Y10T 292/1022; Y10T 292/0969; Y10T 292/0977; Y10T 292/03; Y10T 70/5031; Y10T 70/554; Y10T 70/5544; Y10T 70/5566; Y10T 70/498; Y10T 70/7062; Y10T 70/5558; Y10T 70/40; E05B 65/52; E05B 65/006; E05B 65/0089; E05B 65/0075; E05B 2047/0058; E05B 2047/0094; E05B 2047/0069; E05B 2047/0096; B60R 9/00; B60R 9/065; B60R 5/04; B60R 5/00; B60R 5/045;
(Continued)

(56) References Cited

U.S. PATENT DOCUMENTS 868,473 A * 10/1907 Palmer ..... 403/281
1,070,946 A * 8/1913 Davis ..... 411/120
(Continued)

*Primary Examiner* — Suzanne Barrett
*Assistant Examiner* — Morgan McClure
(74) *Attorney, Agent, or Firm* — Dinsmore & Shohl LLP

(57) ABSTRACT

Locking mechanisms and toolboxes including locking mechanisms are disclosed herein. In one embodiment, a locking mechanism includes a frame including an opening, a lid, a latch coupled to the lid, the latch including a latching post and a flange, and a locking device including a draw mechanism coupled to the tab, where the draw mechanism is translatable with respect to the frame, the draw mechanism including a slot that includes a narrow end and a wide end positioned opposite the narrow end, where the flange has a width that is greater than a width of the narrow end of the slot of the draw mechanism, and where the draw mechanism is repositionable between a latched position in which the narrow end is axially aligned with the latching post of the latch and an unlatched position, in which the wide end is axially aligned with the latching post of the latch.

20 Claims, 6 Drawing Sheets

(51) Int. Cl.

| | |
|---|---|
| ***E05B 67/38*** | (2006.01) |
| ***E05C 9/02*** | (2006.01) |
| ***E05B 15/02*** | (2006.01) |
| ***B25H 3/02*** | (2006.01) |
| *E05B 47/00* | (2006.01) |
| *E05C 9/18* | (2006.01) |

(52) U.S. Cl.

CPC ..... *E05B 67/383* (2013.01); *E05C 9/02* (2013.01); *E05B 47/00* (2013.01); *E05B 2015/0235* (2013.01); *E05B 2047/0058* (2013.01); *E05B 2047/0094* (2013.01); *E05C 2009/1866* (2013.01); *Y10T 70/5031* (2015.04)

(58) Field of Classification Search

CPC .. B60R 5/041; B60R 7/02; B60R 7/04; B60R 7/005; B60R 9/06; B60R 9/10; B60R 9/045; B60R 11/06; B60R 11/00; E05C 1/08; E05C 1/04; E05C 1/02; E05C 1/14; E05C 1/00; E05C 1/10; E05C 1/06; E05C 1/12

USPC ... 70/54–56, 63, 82, 83, 158–164, 166–169; 296/37.5, 37.6; 292/137, 140; 224/403, 224/404

See application file for complete search history.

(56) References Cited

U.S. PATENT DOCUMENTS

| | | | | | |
|---|---|---|---|---|---|
| 1,461,147 | A | * | 7/1923 | Hoff | 292/57 |
| 1,562,965 | A | * | 11/1925 | Hubschmitt, Jr. | 248/237 |
| 2,030,139 | A | * | 2/1936 | Cuozzo | 12/147 R |
| 2,302,957 | A | * | 11/1942 | Rhodes | 292/341.19 |
| 2,582,841 | A | * | 1/1952 | McEwan | 27/17 |
| 2,817,551 | A | * | 12/1957 | Gieleghem | 403/115 |
| 2,912,271 | A | * | 11/1959 | Schaefer | E05B 65/025 292/148 |
| 2,967,317 | A | * | 1/1961 | Richards | 15/119.2 |
| 3,151,375 | A | * | 10/1964 | Schevenell | 27/16 |
| 3,564,879 | A | * | 2/1971 | Bennett | 70/232 |
| 4,282,995 | A | * | 8/1981 | Austin | 224/42.23 |
| 4,290,281 | A | * | 9/1981 | Knaack et al. | 70/54 |
| 4,500,122 | A | * | 2/1985 | Douglas | 292/161 |
| 4,883,294 | A | * | 11/1989 | Goodspeed | 292/148 |
| 4,959,980 | A | * | 10/1990 | Phillips | 70/158 |
| 5,076,078 | A | * | 12/1991 | Weger, Jr. | 70/54 |
| 5,120,094 | A | * | 6/1992 | Eaton et al. | 292/159 |
| 5,235,830 | A | * | 8/1993 | Benge | 70/56 |
| 5,588,631 | A | * | 12/1996 | Yee | 248/553 |
| 5,988,472 | A | * | 11/1999 | McPhail et al. | 224/403 |
| 6,494,064 | B1 | * | 12/2002 | Pena | 70/56 |
| 6,672,546 | B2 | * | 1/2004 | Calleja | 248/58 |
| 6,755,449 | B2 | * | 6/2004 | Weinerman et al. | 292/198 |
| 7,418,846 | B2 | * | 9/2008 | James et al. | 70/159 |
| 7,641,106 | B1 | * | 1/2010 | Kovacs et al. | 235/379 |
| 7,909,419 | B2 | * | 3/2011 | Vinke | 312/215 |
| 8,052,019 | B2 | * | 11/2011 | Plavetich | 224/403 |
| RE44,387 | E | * | 7/2013 | Bridges et al. | 220/326 |
| 8,544,708 | B2 | | 10/2013 | Maimin | |
| 8,733,853 | B2 | * | 5/2014 | Gingrich | 312/216 |
| 8,740,300 | B2 | | 6/2014 | Daniels et al. | |
| 2002/0108410 | A1 | * | 8/2002 | Webb et al. | 70/159 |
| 2003/0011207 | A1 | * | 1/2003 | Campbell | 296/37.6 |
| 2005/0017038 | A1 | * | 1/2005 | Johnson | 224/404 |
| 2006/0071483 | A1 | * | 4/2006 | Jamnia et al. | 292/302 |
| 2006/0102669 | A1 | * | 5/2006 | Fouts et al. | 224/404 |
| 2006/0284437 | A1 | * | 12/2006 | Collins et al. | 296/37.6 |
| 2007/0039957 | A1 | * | 2/2007 | Shulz et al. | 220/210 |
| 2007/0040401 | A1 | | 2/2007 | Poole | |
| 2008/0110893 | A1 | * | 5/2008 | Cowie et al. | 220/324 |
| 2009/0016807 | A1 | * | 1/2009 | Koch | 403/26 |
| 2010/0212376 | A1 | * | 8/2010 | Wagh | E05B 67/383 70/159 |
| 2012/0200096 | A1 | * | 8/2012 | Galloway et al. | 292/145 |
| 2012/0306220 | A1 | | 12/2012 | Hagemeyer et al. | |
| 2013/0180991 | A1 | * | 7/2013 | Williams | 220/324 |

* cited by examiner

LOCKING MECHANISMS AND TOOLBOXES INCLUDING LOCKING MECHANISMS

CROSS REFERENCE TO RELATED APPLICATIONS

This application claims the benefit of priority under 35 U.S.C. §119 to U.S. Provisional Application Ser. No. 61/900,038, filed Nov. 5, 2013, and entitled "Locking Mechanisms For A Toolbox With Floating Latching Post and A Draw Mechanism" the entire disclosure of which is incorporated by reference.

TECHNICAL FIELD

The present application generally relates to locking mechanisms, and more particularly to locking mechanisms for toolboxes.

BACKGROUND

Pickup trucks may be designed to have an enclosed cab and an open truck bed, and the open truck bed can be utilized to transport a variety of materials. For some users, it is desirable to carry tools in the open truck bed. To contain the tools in the open truck bed, pickup trucks may be equipped with a toolbox located in the open truck bed. Toolboxes may be equipped with locking mechanisms to selectively restrict access to the toolbox.

To selectively restrict access to the toolbox and to protect tools within the toolbox from environmental elements, locking mechanisms that assist in forming a relatively tight seal between a lid and the toolbox are desirable. Accordingly, a need exists for alternative locking mechanisms and toolboxes including locking mechanisms.

SUMMARY

In one embodiment, a locking mechanism includes a frame including an opening, a lid that is hingedly coupled to the frame, a latch coupled to the lid, where the latch is selectively positioned at least partially within the opening of the frame, the latch including a latching post and a flange coupled to the latching post, and a locking device including a handle, a tab coupled to the handle, and a draw mechanism coupled to the tab, where the draw mechanism is translatable with respect to the frame, the draw mechanism including a slot that includes a narrow end and a wide end positioned opposite the narrow end, where the flange has a width that is greater than a width of the narrow end of the slot of the draw mechanism, and where the draw mechanism is repositionable between a latched position in which the narrow end is axially aligned with the latching post of the latch and an unlatched position, in which the wide end is axially aligned with the latching post of the latch.

In another embodiment, a toolbox for a vehicle includes a sidewall that extends in an upward direction from a floor, the sidewall including an opening, a lid that is hingedly coupled to the sidewall, where the lid may be selectively positioned between an open position and a closed position, a latch coupled to the lid, where the latch is selectively positioned at least partially within the opening of the side wall, the latch including a latching post and a flange coupled to the latching post, and a locking device including a handle, a tab coupled to the handle, and a draw mechanism coupled to the tab, where the draw mechanism is translatable with respect to the sidewall, the draw mechanism including a slot that includes a narrow end and a wide end positioned opposite the narrow end, where the flange has a width that is greater than a width of the narrow end of the slot of the draw mechanism, and where the draw mechanism is repositionable between a latched position in which the narrow end is axially aligned with the latching post of the latch and an unlatched position in which the wide end is axially aligned with the latching post of the latch.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which FIG. 1 schematically depicts a perspective view of a toolbox including a locking mechanism according to one or more embodiments shown or described herein;

DETAILED DESCRIPTION

Embodiments of the present disclosure generally relate to locking mechanisms and toolboxes that include locking mechanisms. The locking mechanisms include a frame including an opening, and a locking mechanism including a handle, a tab, and a draw mechanism. The draw mechanism may be translatable with respect to the frame. The draw mechanism includes a slot having a narrow end and a wide end that is positioned opposite the narrow end. The draw mechanism is repositionable between a latched position in which the narrow end is axially aligned with the opening of the frame and an unlatched position in which the wide end is axially aligned with the opening of the frame. A lid is hingedly coupled to the frame. A latch is coupled to the lid, where the latch is selectively positioned at least partially within the opening of the frame. In some embodiments, the locking device is included in a toolbox for a vehicle in which the toolbox includes a sidewall and a floor. These and other embodiments will be described in more detail below in reference to the appended drawings.

As used herein, the term "longitudinal direction" refers to the forward-rearward direction of the toolbox (i.e., in the +/−X-direction depicted in FIGS. 1-10). The term "lateral direction" refers to the cross-toolbox direction (i.e., in the +/−Y-direction depicted in FIGS. 1-10), and is transverse to the longitudinal direction. The term "vertical direction" refers to the upward-downward direction of the toolbox (i.e., in the +/−vehicle Z-direction depicted in FIGS. 1-10).

Figure 1:
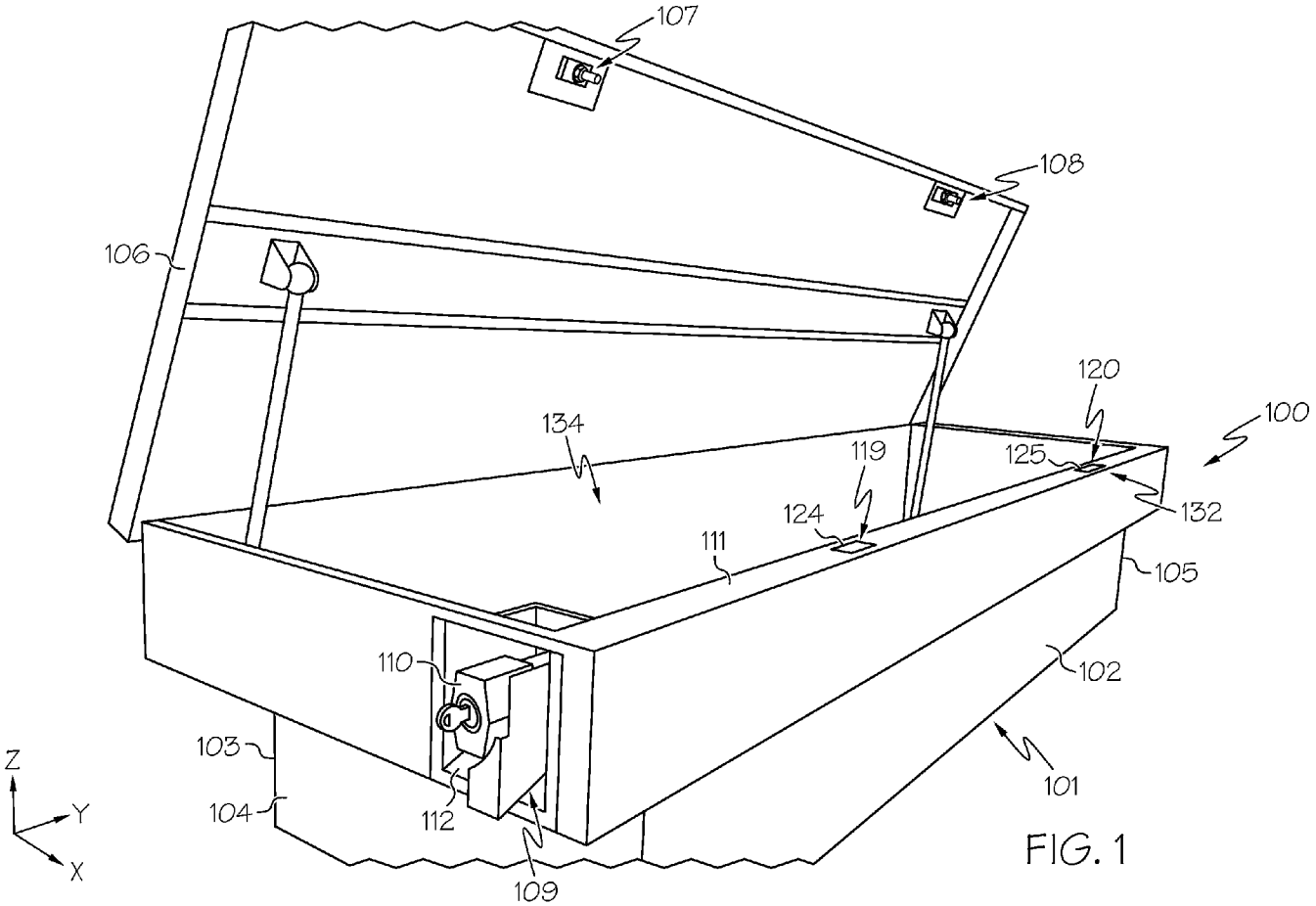

Referring generally to FIG. 1 one embodiment of a toolbox 100 is depicted. The toolbox 100 may be installed in a vehicle, for example, the bed of a pickup truck. The toolbox 100 includes a frame 132. The frame 132 may include a floor 101, a front sidewall 102 and a rear sidewall 103 extending upward from the floor 101 and positioned to oppose one another. The toolbox 100 also includes a first end wall 104 and a second end wall 105 extending upward from the floor 101, and the first end wall 104 and second end wall 105 are coupled to the front sidewall 102 and rear sidewall 103 to form an open-topped enclosed structure. The toolbox also includes a lid 106. The lid 106 is configured to cover an opening 134 of the open-topped enclosed structure. The lid 106 may be hingedly coupled to the rear sidewall 103, so that the lid 106 may be selectively positioned in a closed position and an open position to allow access to the toolbox 100.

The length and width of the floor 101 of the toolbox may be selected to fit inside an open truck bed of a pickup truck. As shown in FIG. 1, the first end wall 104 and second end wall 105 may be shaped such that the length of the toolbox 100 in the lateral direction at a position proximate to the floor 101 in the vertical direction is less than a length of the toolbox 100 in the lateral direction at a position distal from the floor 101 in the vertical direction. The length of the toolbox in the lateral direction at a position distal from the floor 101 in the vertical direction may be selected to hang over the side of the open truck bed of a pickup truck. Further, the front sidewall 102 and rear sidewall 103 of the toolbox 100 may be shaped such that a length of the toolbox 100 in the longitudinal direction is less at a position proximate to the floor 101 in the vertical direction than it is at a position opposite the floor 101.

The lid 106 may be hingedly coupled to the rear sidewall 103 of the toolbox 100. The lid 106 is sized and positioned to fully cover the opening 134 created by the front sidewall 102, rear sidewall 103, and the first end wall 104 and second end wall 105. The lid 106 also includes a first latch 107 and/or a second latch 108 positioned on the lid 106. The first latch 107 and the second latch 108 are positioned to engage the front sidewall 102 when the lid 106 is in the closed position.

As shown in FIG. 1, the toolbox 100 includes a draw mechanism 109, which is shown in greater detail in FIGS. 2-6. The draw mechanism 109 may be engagable with a lock 110 that is positioned on the first end wall 104 adjacent to the front sidewall 102 near the top surface 111 of the front sidewall 102. The lock 110 may be positioned in a compartment 112 of the first end wall 104. Although various locks may be used, a padlock style lock with a u-shaped shank is depicted in FIGS. 2-6. The u-shaped shank 113 of the lock 110 may be coupled to the compartment 112 of the first end wall 104 by an anchor 114.

Figure 2:
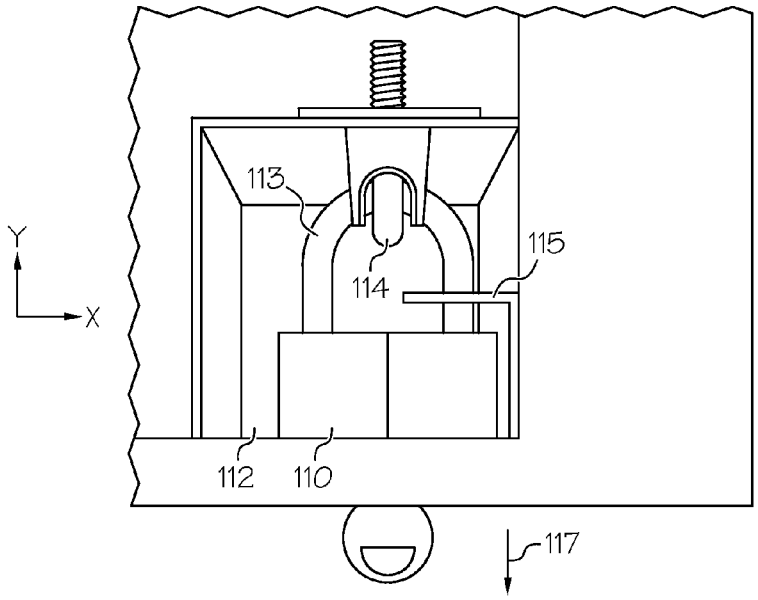
FIG. 2 schematically depicts a top view of a locking device positioned in a locked position and a latched position according to one or more embodiments shown or described herein.
Figure 3:
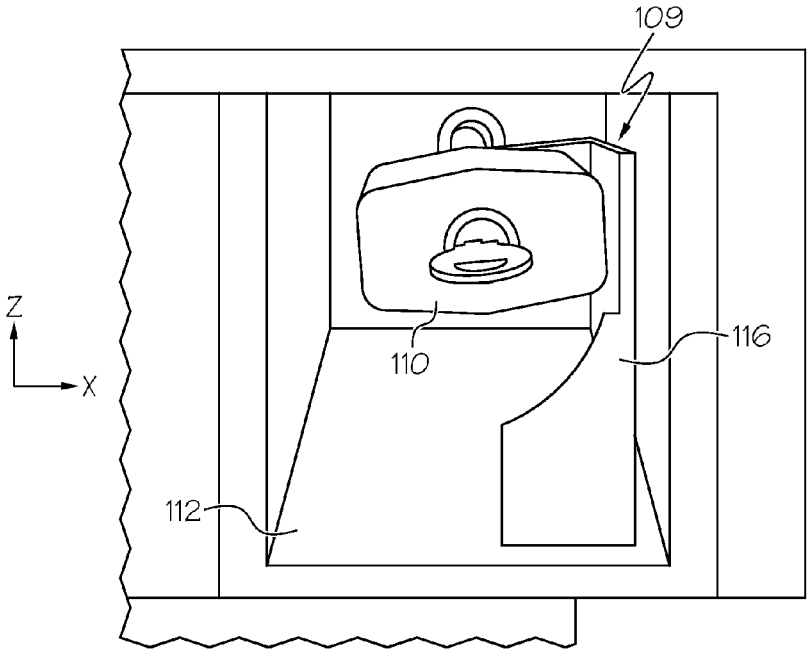
FIG. 3 is schematically depicts a side view of a locking device positioned in a locked position and a latched position according to one or more embodiments shown or described herein.

Referring to FIG. 2, the lock 110 is depicted in a locked position, and is coupled to the compartment 112, with one end of the u-shaped shank 113 engaging a tab 115 that is coupled to the draw mechanism 109. As shown in FIG. 3, the draw mechanism 109 is shown in a latched position, with a handle 116 that is coupled to the draw mechanism 109 positioned within the compartment 112 of the first end wall 104. When the lock 110 is positioned in the locked position and the draw mechanism 109 is positioned in a latched position, the tab 115 that is coupled to the draw mechanism 109 is constrained within the u-shaped shank 113 of the lock 110. The lock 110 is repositionable between the locked position depicted in FIGS. 2 and 3 and an unlocked position, shown in FIGS. 4 and 5. Similarly, the draw mechanism 109 is repositionable between the latched position depicted in FIGS. 2 and 3 and an unlatched position depicted in FIG. 6.

Figure 4:
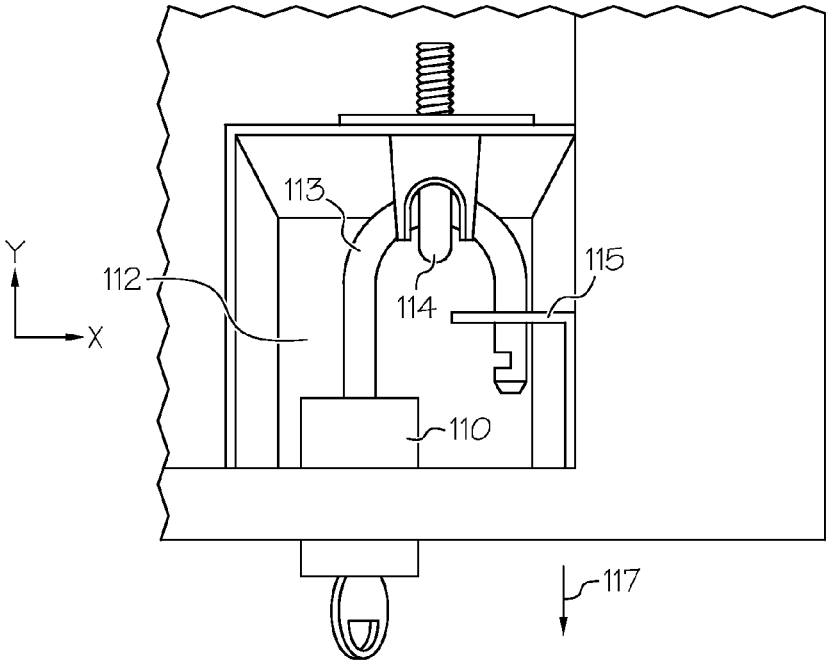
FIG. 4 schematically depicts a top view of a locking device positioned in an unlocked position and a latched position according to one or more embodiments shown or described herein.
Figure 5:
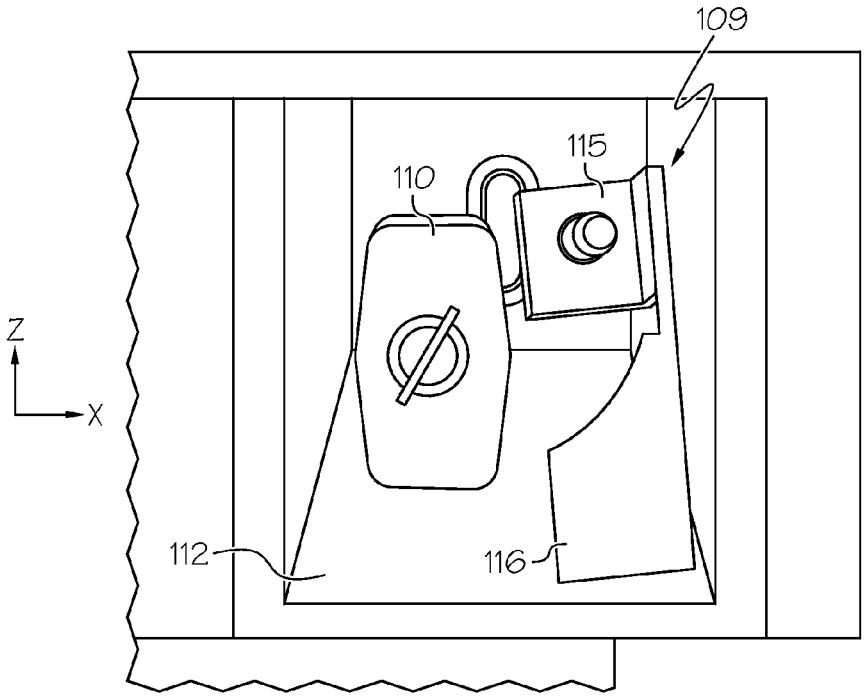
FIG. 5 schematically depicts a side view of a locking device positioned in an unlocked position and a latched position according to one or more embodiments shown or described herein.
Figure 6:
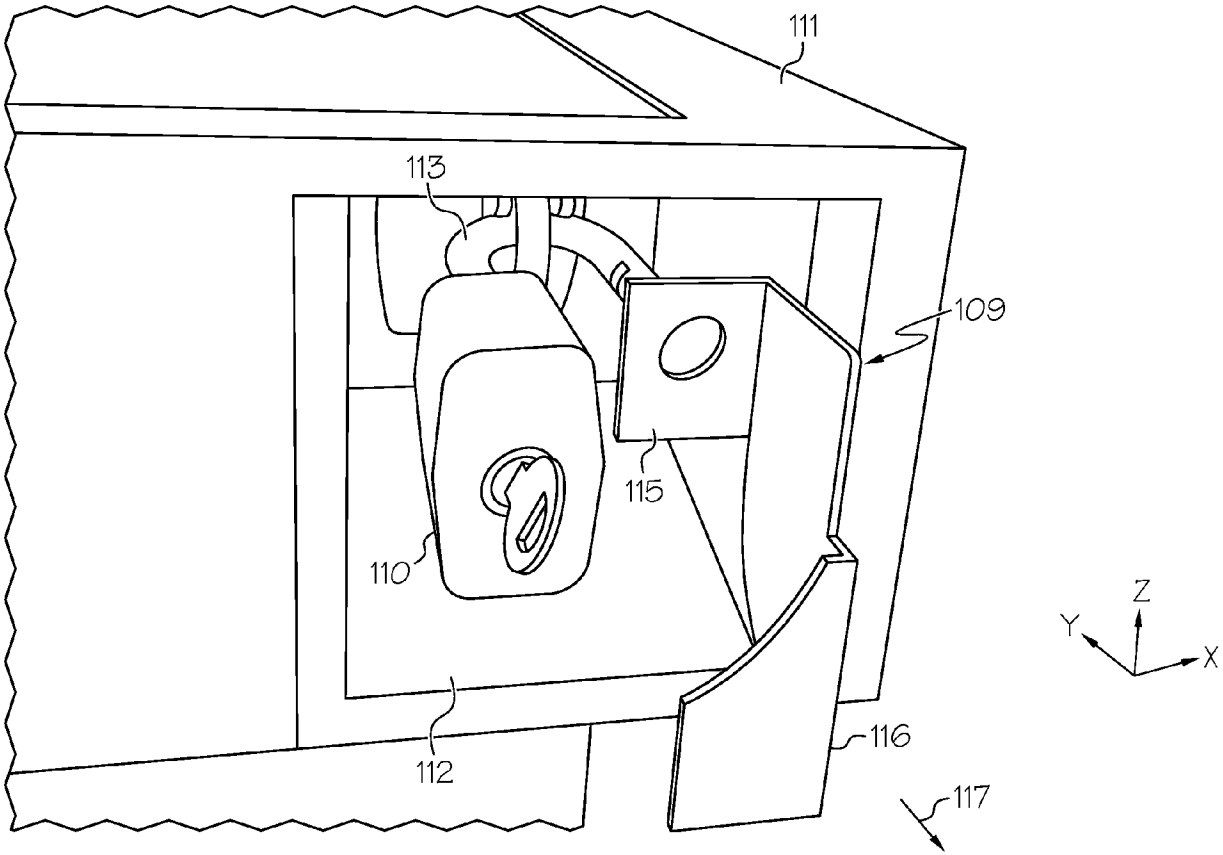
FIG. 6 schematically depicts a perspective view of a locking device positioned in an unlocked and an unlatched position according to one or more embodiments shown or described herein.

Turning now to FIG. 4, the lock 110 is depicted in the unlocked position, with the padlock swung downward in the vertical direction. With the lock 110 in the unlocked position, the tab 115 that is coupled to the draw mechanism 109 is not constrained by the lock 110, and as shown in FIG. 6, the handle 116 may be used to pull the draw mechanism 109 in an outward direction 117 from the first end wall 104.

Figure 7:
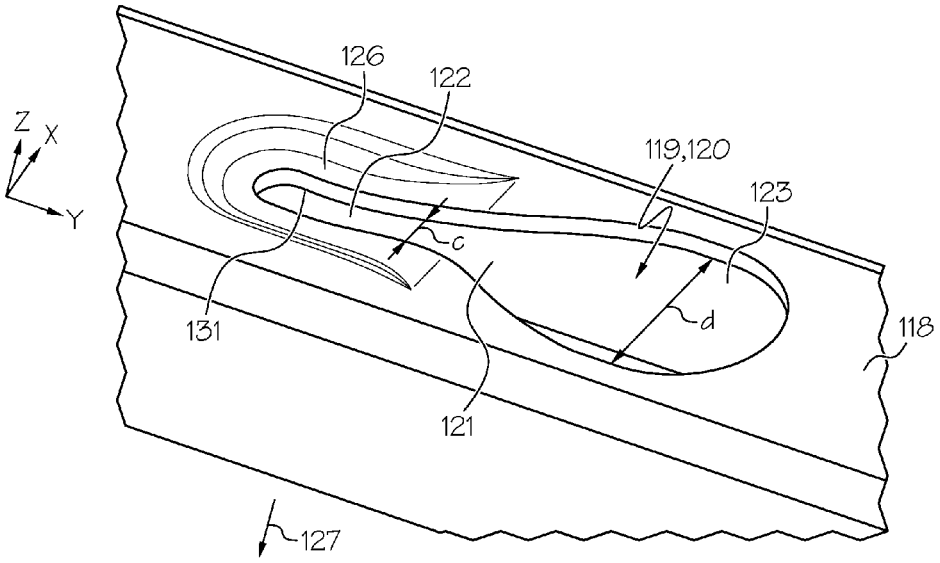
FIG. 7 schematically depicts perspective view of a draw mechanism of a locking device in isolation according to one or more embodiments shown or described herein.

Referring now to FIGS. 1 and 7, the draw mechanism 109 includes a bar 118 that extends along the top of the front sidewall 102. The draw mechanism 109 may be at least partially enclosed within the front sidewall 102 may translate with respect to the front sidewall 102. The bar 118 includes at least one slot. The bar 118 may include a first slot 119 and a second slot 120. The first slot 119 and second slot 120 include an opening 121 that extends axially along the bar 118 in the lateral direction. As shown in FIG. 7, the opening 121 of the first slot 119 and the second slot 120 have a varying width, such that the slot has a narrow end 122 with a width (c) and a wide end 123 with a width (d) that is positioned opposite the narrow end 122. As is clearly shown in FIG. 7, the width (c) of the narrow end 122 is less than the width (d) of the wide end 123.

The bar 118 may include a formed area 126 that may be positioned at the narrow end 122 of the first slot 119 and second slot 120. The formed area 126 of the narrow end 122 at least partially offsets a bottom surface 131 of the bar 118 at the narrow end 122 in a downward direction 127 with respect to the wide end 123.

Figure 8:
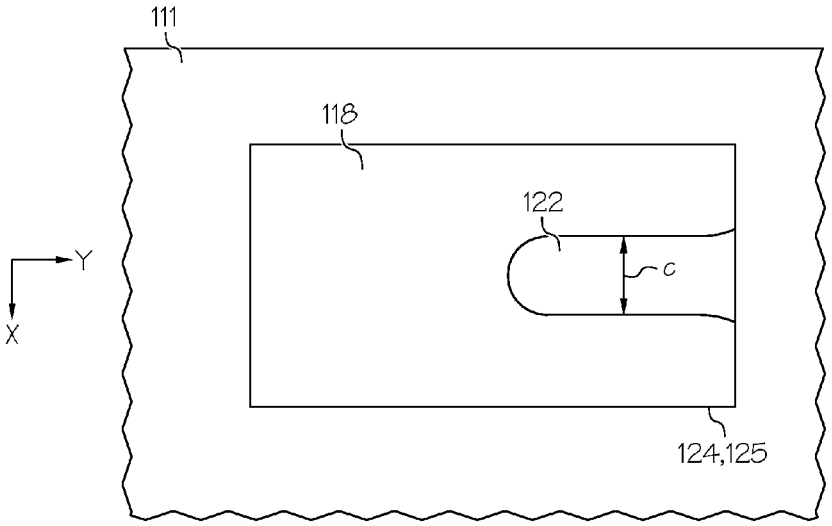
FIG. 8 schematically depicts a top view of a draw mechanism of a locking device shown in a latched position according to one or more embodiments shown or described herein.
Figure 9:
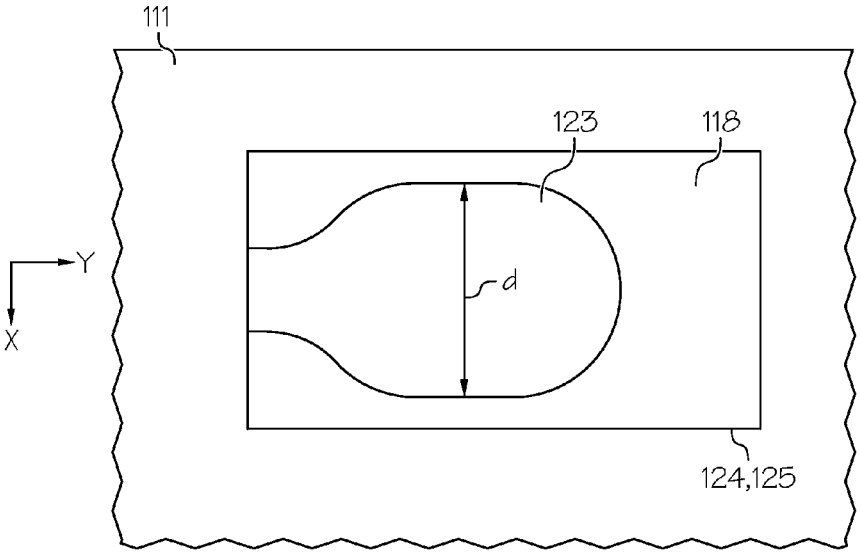
FIG. 9 schematically depicts a top view of a draw mechanism of a locking device shown in an unlatched position according to one or more embodiments shown or described herein.

Referring now to FIGS. 1, 8, and 9, the draw mechanism 109 is depicted. The top surface 111 of the front sidewall 102 includes an opening. The top surface 111 may include a first opening 124 and a second opening 125 that are positioned to align with the first slot 119 and the second slot 120 of the bar 118. Referring to FIGS. 8 and 9 top view of an opening representative of the first opening 124 and the second opening 125 of the front sidewall 102 with the draw mechanism 109 in the latched and unlatched position respectively. As shown in FIGS. 8 and 9, the first opening 124 and second opening 125 on the top surface 111 of the front sidewall 102 partially expose the first slot 119 and second slot 120 of the draw mechanism 109. When the handle 116 of the draw mechanism 109 is pushed in to the first end wall 104 to place the draw mechanism 109 in the latched position, the bar 118 of the draw mechanism 109 translates in the lateral direction such that the narrow end 122 of the first slot 119 and second slot 120 is axially aligned with the first opening 124 and the second opening 125, as shown in FIG. 8. When the handle 116 of the draw mechanism 109 is pulled out from the first end wall 104 to place the draw mechanism 109 in the unlatched position, the wide end 123 of the first slot 119 and second slot 120 is axially aligned with the first opening 124 and the second opening 125, as shown in FIG. 9.

Figure 10:
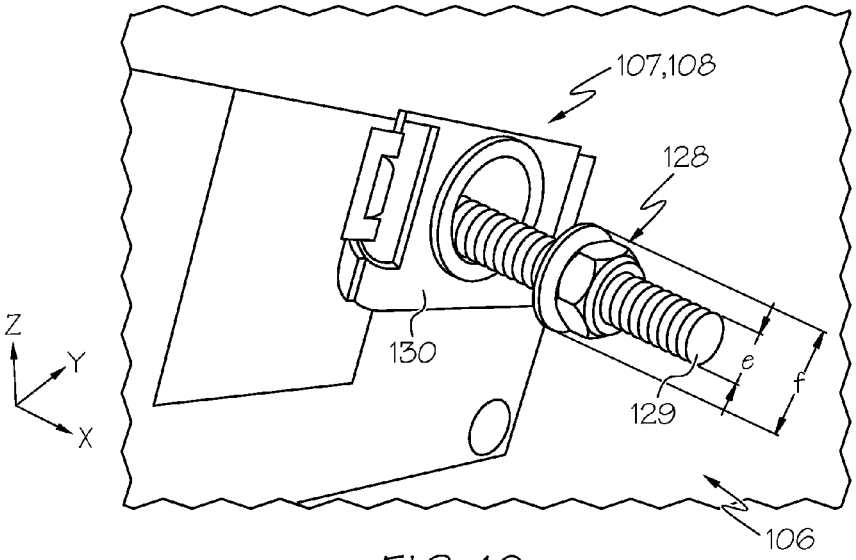
FIG. 10 schematically depicts a perspective view of a latching post and a flange of a latch of the locking device according to one or more embodiments shown or described herein.

The first slot 119 and second slot 120 of the draw mechanism 109 are configured to engage the first latch 107 and/or the second latch 108 that are positioned on the lid 106 of the toolbox 100. Referring now to FIG. 10, a latch representative of the first latch 107 and second latch 108 includes an flange 128 coupled to a latching post 129. The latching post 129 may be coupled to the lid 106 by a housing 130 that allows the latching post 129 freedom of movement within the housing 130 in a radial direction. The flange 128 is coupled to the latching post 129, and may be adjusted in an axial direction on the latching post 129. The latching post 129 has a diameter (e), and the flange 128 has a width (f) that is larger than the diameter (e) of the latching post 129. The width (f) of the flange 128 is less than the width (d) of the first slot 119 and second slot 120 at the wide end 123. However, the width (f) of the flange 128 may be selected to be larger than the width (c) of the first slot 119 and second slot 120 at the narrow end 122. The diameter (e) of the latching post 129 may be smaller than the width (c) of the first slot 119 and second slot 120 at the narrow end 122, and smaller than the width (d) of the first slot 119 and second slot 120 at the wide end 123.

When the lid 106 of the toolbox 100 is brought to the closed position, the first latch 107 and the second latch 108 on the lid 106 engage the first slot 119 and second slot 120 of the draw mechanism 109. When the handle 116 of the draw mechanism 109 is pulled out from the first end wall 104 such that the draw mechanism 109 is in the unlatched position, then the wide end 123 of the first slot 119 and second slot 120 are axially aligned with the first opening 124 and the second opening 125. The first latch 107 and the second latch 108 are axially aligned with the first opening 124 and the second opening 125, respectively. Accordingly, the latching post 129 and flange 128 of the first latch 107 and second latch 108 may pass through the draw mechanism 109 when the lid 106 is brought to the closed position. Once the lid 106 is closed, a user may push the handle 116 of the draw mechanism 109 into the first end wall 104, and the draw mechanism 109 will move in an axial direction to reposition the draw mechanism 109 into the latched configuration. In the latched configuration, the first latch 107 and second latch 108 may engage the narrow end 122 of the first slot 119 and second slot 120 of the draw mechanism 109. With the lid 106 of the toolbox 100 in the closed position, and the draw mechanism 109 in the latched position, the flanges 128 of the first latch 107 and the second latch 108 are captured underneath the narrow end 122 of the first slot 119 and second slot 120 of the draw mechanism 109. Because the diameter (f) of the flange 128 larger than the width (c) of the narrow end 122 of the first slot 119 and second slot 120 of the draw mechanism 109, the lid 106 of the toolbox 100 may not be opened when the draw mechanism 109 is in the latched position.

With the draw mechanism 109 in the latched position, the flange 128 is engaged with the bottom surface 131 of the bar 118. The formed area 126 at the narrow end 122 of the first slot 119 and second slot 120 may apply a downward force in the vertical direction to the first latch 107 and second latch 108 with respect to the front sidewall 102 as a result of the partial offset of the bottom surface 131 of the bar 118 at the narrow end 122. As the first latch 107 and the second latch 108 are pushed in a downward direction with respect to the front sidewall 102, the lid 106 is consequently pushed in a downward direction with respect to the front sidewall 102. The downward force applied to the lid 106 assures a relatively tight engagement between the lid 106 and the front sidewall 102, first end wall 104, and second end wall 105. Because the downward force applied to the lid 106 creates a relatively tight engagement, the draw mechanism 109 may prevent environmental elements from accessing an interior of the toolbox 100 in the latched position. In some embodiments, the draw mechanism 109 may create a water-tight engagement with the lid 106.

Once in the latched position, the tab 115 of the draw mechanism 109 may be engaged with the u-shaped shank 113 of the lock 110. When the lock 110 positioned in the locked position, the tab 115 of the draw mechanism 109 is trapped by the lock 110, preventing a user from pulling the handle 116 from the front sidewall 102 to move the draw mechanism 109 to the unlatched position. As such, a user would not be able to open the lid 106 of the toolbox 100 without unlocking the lock 110.

When the lock 110 is in the unlocked position, the tab 115 is not constrained by the u-shaped shank 113 of the lock 110, and a user may pull the handle 116 in an outward direction 117 from the first end wall 104, translating the draw mechanism 109 to the unlatched position. With the draw mechanism 109 in the unlatched position, the first latch 107 and the second latch 108 of the lid 106 may be aligned with the wide end 123 of the first slot 119 and second slot 120 of the draw mechanism 109. Because the width (d) of the wide end 123 of the first slot 119 and second slot 120 of the draw mechanism 109 is larger than the diameter (f) of the flange 128 of the first latch 107 and the second latch 108, a user may freely open the lid 106 of the toolbox 100 to gain access.

The sidewalls, end walls, lid, and locking mechanism of the toolbox may be made of various materials suitable for outdoor environments, including but not limited to steel, stainless steel, and coated steel.

The latching post may be a threaded post formed from metal material suitable for an outdoor environment, including but not limited to stainless steel. The flange may be a metal nut, the metal a material suitable for an outdoor environment, including but not limited to stainless steel and brass.

It should now be understood that the present disclosure describes locking systems and toolboxes that include locking systems. The toolboxes of the above described disclosure allow a user to lock a toolbox in the open bed of a truck, which may prevent theft of expensive tools. Further, the above described toolboxes allow a user to lock the toolbox using a common, off-the-shelf padlock. In some embodiments, the locking device may include a formed area that applies a downward force to the lid when the locking device is in a latched position, such that the lid forms a relatively tight seal with the toolbox. By forming a relatively tight seal with the toolbox, the locking device may prevent environmental elements from accessing an interior of the toolbox in the latched position.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

What is claimed is:

1. A locking mechanism comprising:

a frame comprising an opening;

a lid that is hingedly coupled to the frame;

a latch coupled to the lid, wherein the latch is selectively positioned at least partially within the opening of the frame, the latch comprising a latching post and a flange coupled to the latching post;

a compartment coupled to and inset from an endwall of the frame such that an interior of the compartment is accessible through the endwall of the frame; and a locking device at least partially housed within the compartment comprising:

a handle selectively translatable into and away from the compartment;

a tab coupled to the handle; and a draw mechanism coupled to the tab and handle such that the handle is positioned at a longitudinal end of the draw mechanism, wherein the draw mechanism is translatable with respect to the frame, the draw mechanism comprising a slot that comprises a narrow end and a wide end positioned opposite the narrow end, wherein the flange has a width that is greater than a width of the narrow end of the slot of the draw mechanism, and wherein the draw mechanism is repositionable between a latched position in which the narrow end is axially aligned with the latching post of the latch and an unlatched position in which the wide end is axially aligned with the latching post of the latch.

2. The locking mechanism of claim 1, wherein the draw mechanism comprises a formed area that is at least partially offset from a bottom surface of the draw mechanism.

3. The locking mechanism of claim 2, wherein the narrow end of the slot comprises the formed area.

4. The locking mechanism of claim 1, wherein the flange is engaged with the narrow end of the slot when the draw mechanism is in the latched position.

5. The locking mechanism of claim 1, wherein the draw mechanism is positioned at least partially within the frame.

6. The locking mechanism of claim 1, further comprising a lock coupled to the frame.

7. The locking mechanism of claim 6, wherein the lock is repositionable between a locked position in which the lock is engaged with the tab and an unlocked position in which the lock is detached from the tab.

8. The locking mechanism of claim 1, wherein the latching post comprises a threaded post and the flange comprises a nut that is adjustable with respect to the threaded post.

9. The locking mechanism of claim 1, wherein the latch comprises a housing, wherein the latching post is coupled to the housing and the latching post has a freedom of movement in a radial direction with respect to the housing.

10. A toolbox for a vehicle comprising:

a sidewall that extends in an upward direction from a floor, the sidewall comprising an opening;

a lid that is hingedly coupled to the sidewall, wherein the lid may be selectively positioned between an open position and a closed position;

a latch coupled to the lid, wherein the latch is selectively positioned at least partially within the opening of the side wall, the latch comprising a latching post and a flange coupled to the latching post;

a compartment coupled to and inset from an endwall of the frame such that an interior of the compartment is accessible through the endwall of the frame; and a draw mechanism at least partially housed within the compartment that is translatable with respect to the sidewall comprising:

a handle;

a tab coupled to the handle; and a bar coupled to the tab comprising a slot that comprises a narrow end and a wide end positioned opposite the narrow end, wherein:

the flange has a width that is greater than a width of the narrow end of the slot of the draw mechanism;

the draw mechanism is repositionable between a latched position in which the narrow end is axially aligned with the latching post of the latch and an unlatched position in which the wide end is axially aligned with the latching post of the latch; and the tab is configured to be attached to a lock when the draw mechanism is positioned in a latched position.

11. The toolbox of claim 10, wherein the toolbox comprises a front sidewall, a rear sidewall positioned opposite of the front sidewall, a first end wall, a second end wall positioned opposite the first end wall, wherein the front sidewall, the rear sidewall, the first end wall, and the second end wall extend in the upward direction from the floor, forming an open-topped enclosed structure.

12. The toolbox of claim 11, wherein the lid covers the open-topped enclosed structure in the closed position.

13. The toolbox of claim 11, wherein the lid is hingedly coupled to the rear sidewall.

14. The toolbox of claim 11, wherein the draw mechanism is positioned at least partially within the front sidewall.

15. The toolbox of claim 11, wherein the lock is coupled to the first end wall.

16. The toolbox of claim 15, wherein the lock is repositionable between a locked position in which the lock is engaged with the tab and an unlocked position in which the lock is detached from the tab.

17. The toolbox of claim 10, wherein the draw mechanism comprises a formed area that is at least partially offset from a bottom surface of the draw mechanism.

18. The toolbox of claim 17, wherein the narrow end of the slot comprises the formed area.

19. The toolbox of claim 10, wherein the flange is engaged with the narrow end of the slot when the draw mechanism is in the latched position.

20. The toolbox of claim 10, wherein the latch comprises a housing, wherein the latching post is coupled to the housing and the latching post has a freedom of movement in a radial direction with respect to the housing.

* * * * *